US007409786B2

(12) United States Patent
Lee

(10) Patent No.: US 7,409,786 B2
(45) Date of Patent: Aug. 12, 2008

(54) HANDHELD PRESSING PAD AND METHOD OF REMOVING WRINKLES

(76) Inventor: Edith Lee, 1300 NW. 43rd St., Kansas City, MO (US) 64116

( * ) Notice: Subject to any disclaimer, the term of this patent is extended or adjusted under 35 U.S.C. 154(b) by 377 days.

(21) Appl. No.: 11/143,111

(22) Filed: Jun. 2, 2005

(65) Prior Publication Data

US 2007/0017129 A1 Jan. 25, 2007

Related U.S. Application Data

(60) Provisional application No. 60/576,489, filed on Jun. 2, 2004.

(51) Int. Cl.
*D06F 79/00* (2006.01)
*D06F 85/00* (2006.01)

(52) U.S. Cl. ..... 38/141; 38/144

(58) Field of Classification Search ..... 38/103, 38/109, 137, 140, 141, 69, 71, 15
See application file for complete search history.

(56) References Cited

U.S. PATENT DOCUMENTS 2,314,498 A * 3/1943 Hoagland ..... 38/141
2,486,718 A * 11/1949 McKinley et al. ..... 38/141
3,703,042 A * 11/1972 Smith ..... 38/69
3,793,753 A * 2/1974 Engelbart ..... 38/77.6
4,621,003 A * 11/1986 O'Kane ..... 428/71
4,817,309 A * 4/1989 Frank et al. ..... 38/15
4,982,516 A * 1/1991 Cervantes ..... 38/140
5,299,372 A * 4/1994 Kelly et al. ..... 38/36
5,355,599 A * 10/1994 Spenneberg, Jr. ..... 38/141
7,121,024 B1 * 10/2006 Clevenberg ..... 38/71

* cited by examiner

*Primary Examiner*—Ismael Izaguirre
(74) *Attorney, Agent, or Firm*—Sonnenschein Nath & Rosenthal LLP; Bryan P. Stanley

(57) ABSTRACT

A method of removing wrinkles, and a device to assist in wrinkle removal is provided. Wrinkles are removed from items such as clothing, linens, curtains, upholstery, fabrics and the like by placing a handheld pad on one side of the item, a wrinkle-removing device (such as a nozzle of a garment steamer) on the other side of the item, and pressing a portion of the item between the pad and the wrinkle-removing device. The wrinkle-removing device and the pad are moved about the item compressing a small portion of the item at a time until the wrinkles are removed from the entire item. The pad device of the instant invention includes a working surface against which a portion of the item is pressed by the wrinkle removing device, and a handgrip for the user to support the pad on a user's hand. The pad includes a foam core that insulates the user's hand from heat of the wrinkle-removing device. The foam core is located within a heat-reflective pouch to further insulate the user's hand and to aid in wrinkle removal.

11 Claims, 1 Drawing Sheet

HANDHELD PRESSING PAD AND METHOD OF REMOVING WRINKLES

This application claims priority pursuant to 35 U.S.C. 119 (e) to U.S. Provisional Patent Application Ser. No. 60/576,489, filed Jun. 2, 2004, the entire disclosure of which is incorporated herein by reference.

FIELD OF THE INVENTION

The present invention relates generally to a method of removing wrinkles, and a device used to assist in pressing, ironing, steaming, or otherwise removing wrinkles from, clothes, linens, curtains, upholstery, fabrics and other similar items. More particularly, it is concerned with the use of a handheld pad for supporting a portion of an object from which wrinkles are being removed. The handheld pad of the instant invention is particularly well suited for use in steam pressing (steaming) vertically hung objects.

BACKGROUND OF THE INVENTION

Several alternative devices currently exist for removing wrinkles from clothing, linens, curtains, upholstery, fabrics and other similar items. Examples of such devices include presses, irons/ironing boards and garment steamers. Each of these devices provides varying levels of wrinkle removal and convenience of use.

Generally, a press includes two large flat surfaces that are connected together by a hinge or other similar connection. Items are located between the two surfaces and the surfaces are compressed together. Steam is often injected between the compressed surfaces to aid in wrinkle removal. A press is desirable in that it generally removes wrinkles from an entire garment, or a large portion of the item, all at one time, and provides clean, long-lasting creases. Nevertheless, presses are very bulky and generally only well-suited for removing wrinkles from a limited variety of items such as pants, which can be folded in half along a crease.

Irons are less bulky, and generally more versatile than presses. An iron is usually used in conjunction with an ironing board which supports the item being ironed in a horizontal position. Generally, a section of the item is laid out flat on the horizontal ironing board and the hot iron (often steaming) is moved across the item to remove wrinkles as the item is compressed between the iron and the ironing board. In this manner an iron and ironing board function similar to a press for a smaller portion of the item. Ironing can be very tedious as the item being ironed must often be repositioned several times on the ironing board to remove all wrinkles. Use of an iron can result in damage, such as scorching, to the item being ironed if the iron is left at a single position for an excessive amount of time. In addition, the ironing board itself is very bulky and cumbersome to use.

An alternative to ironing, which eliminates the use of an ironing board and which eliminates the potential for damage to the wrinkled item, is the garment steamer. A garment steamer produces a large volume of steam that is expelled through a hand-held nozzle. Due to the thermo-dynamic properties of the steam, which rises when exposed to the cooler air of the environment surrounding the wrinkled item, garment steamers generally require that the wrinkled items be supported vertically instead of horizontally. Thus, items such as shirts, pants and other garments are generally supported vertically by clothing hangers when a garment steamer is used for wrinkle removal. The steam penetrates and relaxes the fabric to remove the wrinkles. Sometimes the user of the garment steamer will aid the steam in removing wrinkles by tugging on the bottom of the item to stretch the fabric. Although garment steamers are much faster and easier to remove the majority of wrinkles from an item than an iron, it is difficult to provide as crisp an appearance as can be obtained when the item is compressed between the iron and ironing board (or when pressed). This is particularly the case when an item contains excessively stubborn wrinkles. Nevertheless, the need to support wrinkled items vertically during steaming makes the use of an ironing board difficult, if not impossible. Therefore, it would be beneficial to provide an improved method of removing wrinkles and a device to aid in compressing an item that is hung vertically during wrinkle removal by a garment steamer.

SUMMARY OF THE INVENTION

An object of the instant invention is to provide a method of removing wrinkles from an item such as clothes, linens, curtains, upholstery, fabrics and other similar items.

Another object of the instant invention is to provide an apparatus to aid in the removal of wrinkles from an item that is hanging vertical. Yet another object of the instant invention is to provide an apparatus that aids in the removal of wrinkles from an item that is hanging vertical by permitting compression of the item.

The objects of the instant invention are accomplished through the use of a hand-held pad. The pad provides a generally flat working surface against which a wrinkled item can be pressed during wrinkle removal, and functions to protect a user's hand from heat generated by the wrinkle-removing device (i.e. garment steamer nozzle or iron) positioned on an opposing side of the item from the pad. The item is compressed between the wrinkle-removing device (such as the nozzle of the steamer) and the pad, in a manner similar to that of an iron and ironing board. The pad and the wrinkle-removing device are generally simultaneously moved, generally in unison, about an item compressing a small portion of the item at a time until the wrinkles are removed from the entire item.

The relatively small size of the pad compared to that of an ironing board allows the pad to be positioned in a variety of locations not possible with ironing boards of the prior art. For example, the pad can be positioned within shirt sleeves or pant legs, to allow compression of a single layer of fabric for the item, as opposed to larger ironing boards which require that opposing sides of a shirt sleeve or pant leg be folded or creased together during wrinkle removal such that two layers of fabric are compressed between the iron and the ironing board. Nevertheless, if desired, the pad of the instant invention can be located on opposing sides of an item such as a shirt sleeve or pant leg in a manner similar to prior art ironing boards to provide a crisp crease.

The pad of the instant invention is particularly useful in connection with wrinkle removal devices such as garment steamers in which vertical hanging of the wrinkled item is preferred. Notwithstanding, it will be appreciated that the pad of the instant invention could be utilized in combination with other wrinkle removing devices, such as irons.

The pad includes a generally flat working surface against which a portion of a wrinkled item can be pressed. A handle is located on the surface of the pad opposing the working surface. The pad includes an inner core constructed of foam or any other suitable material. In the described embodiment, the foam provides rigidity to the structure of the pad, and also provides insulation between the user's hand and the heat from the wrinkle removal device (such as a steamer or iron). The thickness of the core and type of materials used for the core can vary depending upon the desired rigidity and insulating characteristics for the pad. In a preferred embodiment, the foam core is contained within a pouch, and the handle is attached to the exterior of the pouch. In a preferred embodiment, the pouch is constructed of a heat reflective material, such as the material commonly used for ironing board covers. In yet another preferred embodiment, the pouch includes an opening and a flap covering the opening to permit removal of the foam core for cleaning of the pad.

In the depicted embodiment, the handle is constructed of two hook and pile strips, such as VELCRO, that are releasably connected together to permit adjustment of the handle size based upon the size of the user's hand. The handle is located near the bottom portion of the pad to provide support for the user's hand such that the user's fingers extend across the back surface of the pad without extending beyond the pad. This permits the user to apply sufficient leverage to be applied to the pad during pressing while also protecting the user's fingers from the heat of the wrinkle removing device. It will be appreciated that alternative means for holding the pad (i.e. alternative "handgrips") can be developed without departing from the spirit and scope of the instant invention. For example, the handle described above can be eliminated and a pocket can be included in the pad to act as the handgrip, such that the pad is worn by the user like a glove.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
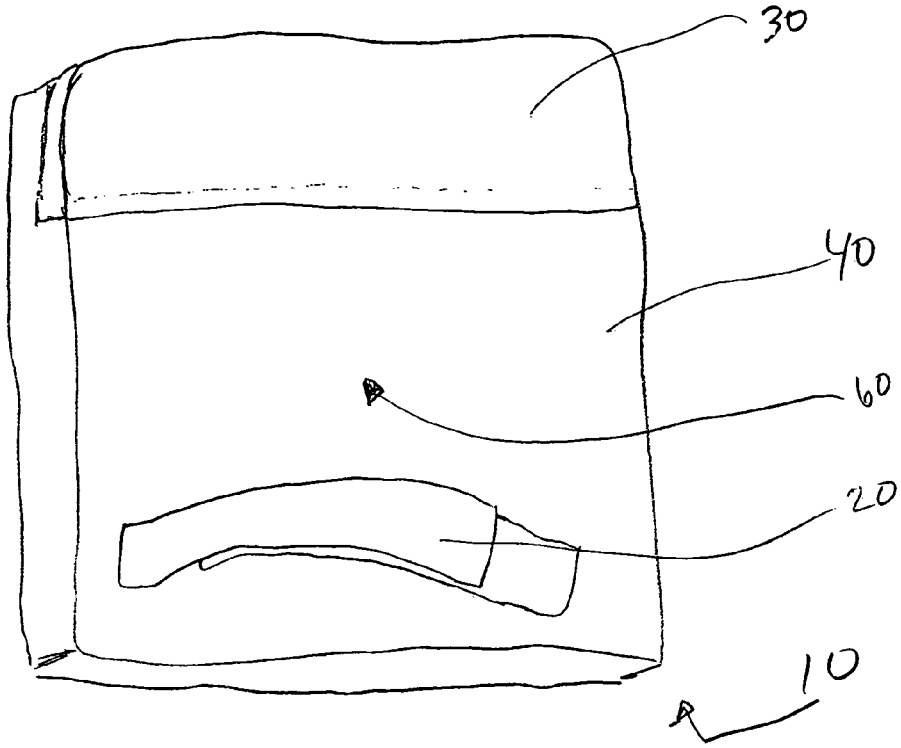
FIG. 1 is a rear perspective view of one embodiment of a hand held pad of the instant invention.
Figure 2:
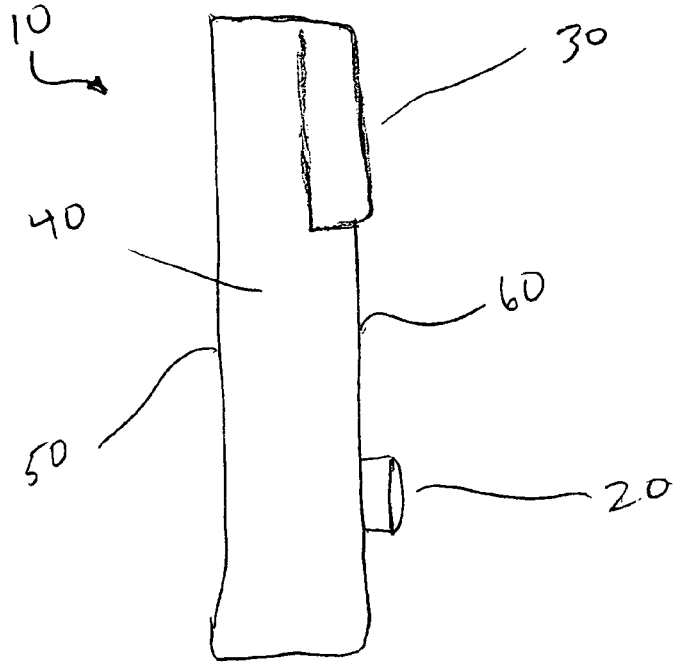
FIG. 2 is a side elevation view of the pad of FIG. 1.

Referring to FIGS. 1 and 2 a pressing pad of the device instant invention, and for use in the method of the instant invention, is provided. Pad 10 includes outer pouch 40 that housing a foam core (not shown). Handle 20, constructed of hook and pile strips is attached towards the bottom of back surface 60 of pad 10. Locating handle 20 towards the bottom of pad 10 allows a user's hand to be inserted through handle 20 upward from the bottom, so that the pad protects the user's hand from heat that is applied by a wrinkle-removing device (such as a garment steamer nozzle) to front surface 50 of pad 10.

In the embodiment shown in FIGS. 1 and 2, outer pouch 40 of pad 10 includes flap 30 that covers an opening through which the foam core can be inserted and removed for cleaning of pad 10. In an alternative embodiment, flap 30 is not included as the foam core is permanently sewn into pouch 40.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A method of removing wrinkles from items, said method comprising the steps of:

supporting an item in a vertical orientation;

positioning a steam-generating wrinkle-removing device on a first side of the item;

positioning a pad an other side of the item opposite the first side, said pad being independent of said wrinkle-removing device;

pressing a portion of the item between the wrinkle-removing device and the pad while said item is supported in said vertical orientation; and moving independently the wrinkle-removing device and the pad generally in unison to another about a portion of the item.

2. The method as claimed in claim 1 wherein the wrinkle-removing device comprises a nozzle of a garment steamer.

3. The method as claimed in claim 1 wherein the wrinkle-removing device comprises an iron.

4. The method as claimed in claim 1 wherein the pad comprises a heat reflective material.

5. The method as claimed in claim 4 wherein the pad further comprises a generally rigid material.

6. The method as claimed in claim 5 wherein the generally rigid material comprises a foam material.

7. The method as claimed in claim 1 wherein the pad includes a handgrip.

8. A handheld device to assist in pressing, ironing, steaming, or otherwise removing wrinkles from an item, said device comprising:

a pad including a working surface; and a handgrip associated with said pad to support said pad on a user's hands;

wherein said pad comprises a generally rigid material located within a heat reflective layer; and wherein said heat reflective layer includes an opening for insertion and removal of said generally rigid material.

9. The device as claimed in claim 8 wherein said generally rigid material comprises a foam material.

10. The device as claimed in claim 8 wherein said handgrip comprises a handle attached to said pad.

11. The device as claimed in claim 8 wherein said handgrip comprises a pocket within said pad.

* * * * *